US010058743B2

(12) United States Patent
Smith

(10) Patent No.: US 10,058,743 B2
(45) **Date of Patent: *Aug. 28, 2018**

(54) MOLDED GAME BALL

(71) Applicant: RAWLINGS SPORTING GOODS COMPANY, INC., St. Louis, MO (US)

(72) Inventor: Katherine A. Smith, Eureka, MO (US)

(73) Assignee: Rawlings Sporting Goods Company, Inc., St. Louis, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/790,039

(22) Filed: Jul. 2, 2015

(65) Prior Publication Data

US 2015/0297954 A1 Oct. 22, 2015

Related U.S. Application Data

(63) Continuation of application No. 13/544,273, filed on Jul. 9, 2012, now Pat. No. 9,101,800.

(60) Provisional application No. 61/505,792, filed on Jul. 8, 2011.

(51) Int. Cl.

| | |
|---|---|
| ***A63B 37/12*** | (2006.01) |
| ***A63B 37/14*** | (2006.01) |
| ***A63B 45/00*** | (2006.01) |
| *A63B 37/04* | (2006.01) |
| *A63B 102/18* | (2015.01) |

(52) U.S. Cl.

CPC ..... *A63B 37/12* (2013.01); *A63B 37/14* (2013.01); *A63B 45/00* (2013.01); *A63B 37/04* (2013.01); *A63B 2037/125* (2013.01); *A63B 2102/18* (2015.10)

(58) Field of Classification Search

CPC ... A63B 37/12; A63B 37/15; A63B 2037/125; A63B 45/00; A63B 2243/0004; A63B 37/04

See application file for complete search history.

(56) References Cited

U.S. PATENT DOCUMENTS

| | | | |
|---|---|---|---|
| 2,388,776 | A | 1/1942 | Wallace |
| 2,325,128 | A | 7/1943 | Grady |
| 2,645,487 | A | 7/1953 | Hawes |
| 2,743,931 | A | 5/1956 | Pooley |
| 2,753,599 | A | 7/1956 | Pietraszek |
| 2,938,237 | A | 5/1957 | Kern et al. |
| 4,154,789 | A | 5/1979 | Delacoste |
| 4,256,304 | A | 3/1981 | Smith et al. |
| 4,463,951 | A | 8/1984 | Kumasaka et al. |
| 4,498,667 | A | 2/1985 | Tomar |
| 4,653,752 | A | 3/1987 | Miller |
| 4,660,830 | A | 4/1987 | Tomar |
| 4,725,058 | A | 2/1988 | Molitor |
| 4,729,566 | A | 3/1988 | Molitor |
| 4,808,272 | A | 2/1989 | Molitor |
| 4,822,041 | A | 4/1989 | Molitor |

(Continued)

FOREIGN PATENT DOCUMENTS

| | | |
|---|---|---|
| AU | 1 507 433 | 4/1978 |

*Primary Examiner* — Steven Wong

(74) *Attorney, Agent, or Firm* — Husch Blackwell LLP

(57) ABSTRACT

A molded game ball comprises an outer cover or surface having a mold line that mimics the seam of a conventional baseball or softball. The outer cover or surface may additionally include a stitch pattern that mimics the stitching of a conventional baseball or softball.

44 Claims, 6 Drawing Sheets

(56) References Cited

U.S. PATENT DOCUMENTS

| | | | | |
|---|---|---|---|---|
| 4,840,378 | A | 6/1989 | Molitor | |
| 5,035,425 | A | 7/1991 | Edwards | |
| 5,123,659 | A | 6/1992 | Williams | |
| 5,150,906 | A | 9/1992 | Molitor et al. | |
| 5,356,941 | A | 10/1994 | Sullivan et al. | |
| 5,588,648 | A | 12/1996 | Stebbins | |
| 5,647,590 | A | 7/1997 | Walker et al. | |
| 5,711,729 | A | 1/1998 | Chan | |
| 5,833,897 | A | 11/1998 | Grimm | |
| 5,893,808 | A | 4/1999 | Bennett | |
| 6,045,665 | A | 4/2000 | Ohhashi et al. | |
| 6,458,052 | B1 | 10/2002 | Pitsenberger et al. | |
| 6,592,477 | B1 | 7/2003 | Yang | |
| 6,719,653 | B1 | 4/2004 | Nesbitt | |
| 8,168,026 | B1 | 5/2012 | Brown et al. | |
| 8,342,832 | B2 * | 1/2013 | Chen | B29C 45/006 425/112 |
| 9,101,800 | B2 * | 8/2015 | Smith | A63B 37/12 |
| 9,205,310 | B1 * | 12/2015 | Hampton | A63B 39/00 |
| 2001/0000507 | A1 | 4/2001 | Uchida et al. | |
| 2001/0038167 | A1 | 11/2001 | Brune | |
| 2003/0153418 | A1 | 8/2003 | Lee | |
| 2007/0100089 | A1 | 5/2007 | Nesbitt et al. | |
| 2008/0051233 | A1 | 2/2008 | Nesbitt et al. | |
| 2009/0243134 | A1 | 10/2009 | Hu | |
| 2009/0325744 | A1 | 12/2009 | Raynak et al. | |
| 2012/0241080 | A1 | 9/2012 | Chen | |
| 2012/0244247 | A1 | 9/2012 | Chen | |
| 2012/0244283 | A1 | 9/2012 | Chen | |
| 2012/0244971 | A1 | 9/2012 | Chen | |
| 2014/0066238 | A1 | 3/2014 | Smith et al. | |

* cited by examiner

MOLDED GAME BALL

CROSS-REFERENCE TO RELATED APPLICATIONS

This application is a continuation of and claims priority to U.S. Non-Provisional application Ser. No. 13/544,273 filed Jul. 9, 2012 which is based on and claims priority to U.S. Provisional Application Ser. No. 61/505,792, filed Jul. 8, 2011, both of which are incorporated herein by reference in its entirety.

STATEMENT REGARDING FEDERALLY SPONSORED RESEARCH OR DEVELOPMENT

Not applicable.

BACKGROUND OF THE INVENTION

1. Field of the Invention

The present invention is directed toward a molded game ball and a process for making the same, and in particular, to a molded game ball that closely resembles a conventional, stitched competition softball or baseball.

2. Description of Related Art

Conventional, competition softballs and baseballs include an inner core that is enclosed by a pair of figure eight shaped cover panels. The cover panels are hand stitched together along their peripheral edges. Hand stitching softball and baseball cover panels is a labor-intensive process that increases the cost of producing softballs and baseballs. Accordingly, several methods have been developed for producing these balls that do not require hand stitching. One such method is molding the entire ball or a portion of the ball with simulated stitching on an outer surface of the ball. While this method is suitable for manufacturing low cost, replica softballs and baseballs, conventional molded balls are not acceptable replacements for competition ready balls for a variety of reasons. For example, a conventional molded ball typically has a mold line that is formed on the ball during the molding process because of the joint between the two halves of the mold that is used to create the ball. Additionally, conventional molded balls do not typically closely resemble stitched balls. Accordingly, the industry does not accept molded balls as suitable replacements for competition ready stitched balls.

BRIEF SUMMARY OF THE INVENTION

The present invention is directed toward a molded game ball and a process for making the same. The game ball is made by a two-step molding process whereby a relatively thin bladder-type outer cover having a pattern that mimics the seam and stitches of a conventional game ball is first formed in a mold, and then material is injected into an interior volume enclosed by the outer cover to form an inner core that permanently bonds with the outer cover.

The mold has a pattern positioned to mimic the inverse of the seam and stitch pattern that will be formed on the outer cover. Preferably, the mold has first and second halves that are each shaped like one of the cover panels of a conventional softball or baseball. Preferably, the mold pattern is formed in the inner surface of each of the first and second halves adjacent to the peripheral edges of the halves so that the mold line is not discernible, but instead appears to be the seam of a conventional game ball. Preferably, the core material is injected into the outer cover through an orifice in the area of the stitch pattern so as to ensure that no discernible mold injection point is formed on the game ball. The game ball made according to this process is preferably a softball or baseball that closely resembles a conventional, stitched competition softball or baseball.

The present invention is also directed toward a game ball having a molded outer cover with a stitch pattern that mimics the pattern of a seam of a conventional game ball. The ball has an inner core that is enclosed by the outer cover and that is permanently bonded with the outer cover. The inner core is molded within the outer cover after the outer cover is molded. Preferably, the game ball is a softball or baseball that has no discernible mold line or mold injection point. Preferably, the game ball closely resembles a conventional, competition softball or baseball.

Additional aspects of the invention, together with the advantages and novel features appurtenant thereto, will be set forth in part in the description which follows, and in part will become apparent to those skilled in the art upon examination of the following, or may be learned from the practice of the invention. The objects and advantages of the invention may be realized and attained by means of the instrumentalities and combinations particularly pointed out in the appended claims.

DETAILED DESCRIPTION OF PREFERRED EMBODIMENT

Figure 1:
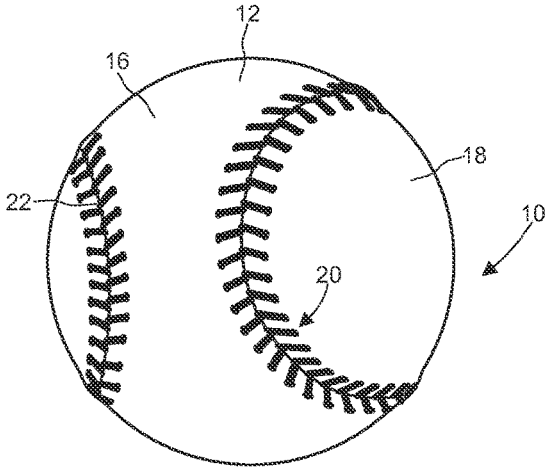
FIG. 1 is a perspective view of a game ball in accordance with the present invention.
Figure 3:
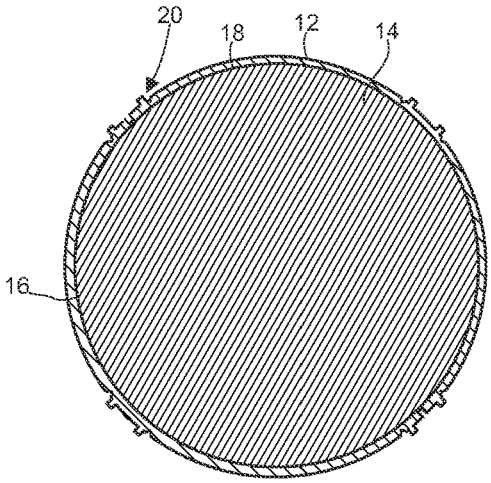
FIG. 3 is a cross-sectional view taken through the line 3-3 in FIG. 2.

Referring to FIG. 1, a molded game ball in accordance with the present invention is shown generally as 10. Game ball 10 is a softball or baseball; however, it is within the scope of the present invention for game ball 10 to be a different type of ball. The game ball 10 has a molded outer cover 12 and an inner core 14 (FIG. 3) that is enclosed by and permanently chemically bonded with the outer cover 12. As discussed in more detail below, the material for forming the inner core 14 is injected within the outer cover 12 after the outer cover 12 has already been formed.

Outer cover 12 has two relatively smooth generally C-shaped sections 16 and 18 that are bordered by a stitch pattern 20 mimicking the appearance and texture of the seam and stitching of a conventional, competition softball or baseball. The C-shaped sections 16 and 18 and stitch pattern 20 are formed together as an integral round cover. C-shaped sections 16 and 18 have the same size, shape, and appearance as the cover panels of a conventional, competition softball or baseball. Stitch pattern 20 has the same size, shape, and appearance as the stitching and seam of a conventional, competition softball or baseball.

Figure 2:
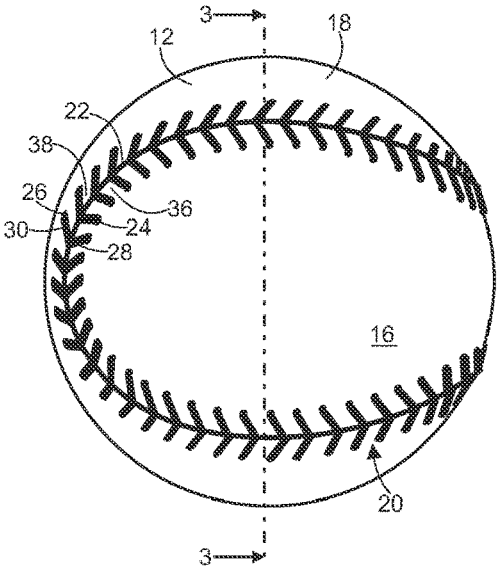
FIG. 2 is a side elevational view of the game ball of FIG. 1.
Figure 4:
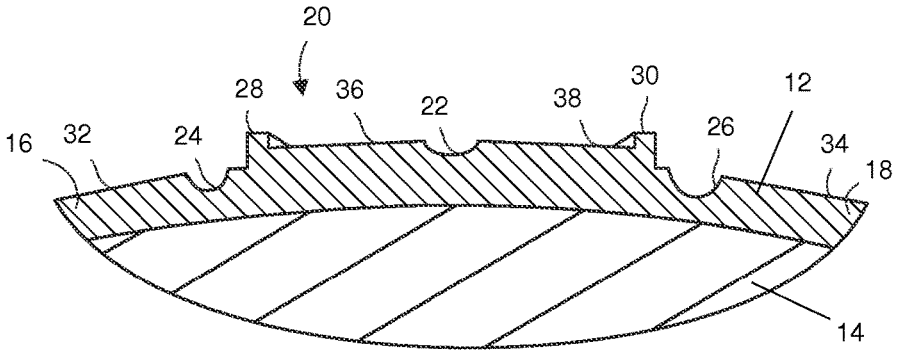
FIG. 4 is an up-close cross-sectional view of a portion of a stitch pattern of the game ball.

Referring to FIGS. 2 and 4, stitch pattern 20 includes a shallow groove 22 that is positioned between C-shaped sections 16 and 18. The groove 22 mimics the appearance of the joint between the abutting cover panels of a conventional softball or baseball. Stitch pattern 20 also includes a plurality of shallow pin-hole shaped depressions, one of which is shown as 24, adjacent C-shaped section 16 that are spaced equidistant from each other and from groove 22, and a plurality of shallow pin-hole shaped depressions, one of which is shown as 26, adjacent C-shaped section 18 that are spaced equidistant from each other and from groove 22. The depressions 24 and 26 mimic the appearance of the holes formed in the cover panels of a conventional softball or baseball through which stitching is threaded to join the panels. Stitch pattern 20 includes a plurality of stitch shaped protrusions, one of which is shown as 28, that extend from fixed points along groove 22 to one of depressions 24 on C-shaped section 16. These protrusions generally extend from groove 22 at about a 45 degree angle and are positioned generally parallel one another. A plurality of stitch shaped protrusions, one of which is shown as 30, also extend from the fixed points along groove 22 to one of depressions 26 on C-shaped section 18. These protrusions generally extend from groove 22 at about a 45 degree angle and are positioned generally parallel one another such that the protrusions on each section together define a series of arrow shaped protrusions. The protrusions on outer cover 12 mimic the appearance of the stitching on a conventional baseball or softball.

Referring to FIG. 4, C-shaped sections 16 and 18 of outer cover 12 have outer surfaces 32 and 34, respectively, that are generally smooth to mimic the appearance of the outer surfaces of the cover panels of a conventional baseball or softball. Outer cover 12 has a plurality of surfaces, one of which is shown as 36, that are positioned between adjacent protrusions 28 from groove 22 to depressions 24. Likewise, outer cover 12 has a plurality of surfaces, one of which is shown as 38, that are positioned between adjacent protrusions 30 from groove 22 to depressions 26. As shown in FIG. 4, surfaces 36 and 38 are raised above surfaces 32 and 34 to mimic the appearance of the peripheral edge or seam area of the cover panels of a conventional baseball or softball which are raised relative to the remainder of the outer surface of the cover panels when the cover panels are stitched together. Although surfaces 36 and 38 are shown in FIG. 4 as being generally flat, it is within the scope of the invention for surfaces 36 and 38 to be curved or undulated to more closely mimic the appearance of the peripheral edge or seam area of the cover panels of a conventional softball or baseball.

The outer cover 12 and inner core 14 of game ball 10 are preferably formed from polyurethane according to the process described below, albeit other suitable materials may be used for outer cover and/or inner core. Outer cover 12 is preferably formed of a relatively high density polyurethane that provides a protective and durable skin. Inner core 14 is preferably formed of a lower density rigid polyurethane foam to give it good hitting distances and flight characteristics. The outer cover 12 preferably has a thickness of between approximately 1.4 to 1.6 millimeters, and most preferably a thickness of approximately 1.5 millimeters. The ball 10 preferably has approximately the same diameter, density, and weight as any type of conventional, competition baseball or softball.

The finished game ball 10 preferably travels a farther distance when hit than a conventional competition baseball or softball. It is believed that the longer distance is attributable to the permanent chemical bond between the outer cover 12 and inner core 14 which prevents slippage between the outer cover 12 and inner core 14. It is believed that the longer distance is also attributable to the polyurethane material that is used for the outer cover 12 which has a greater coefficient of friction than the material used for conventional game balls.

Figure 5:
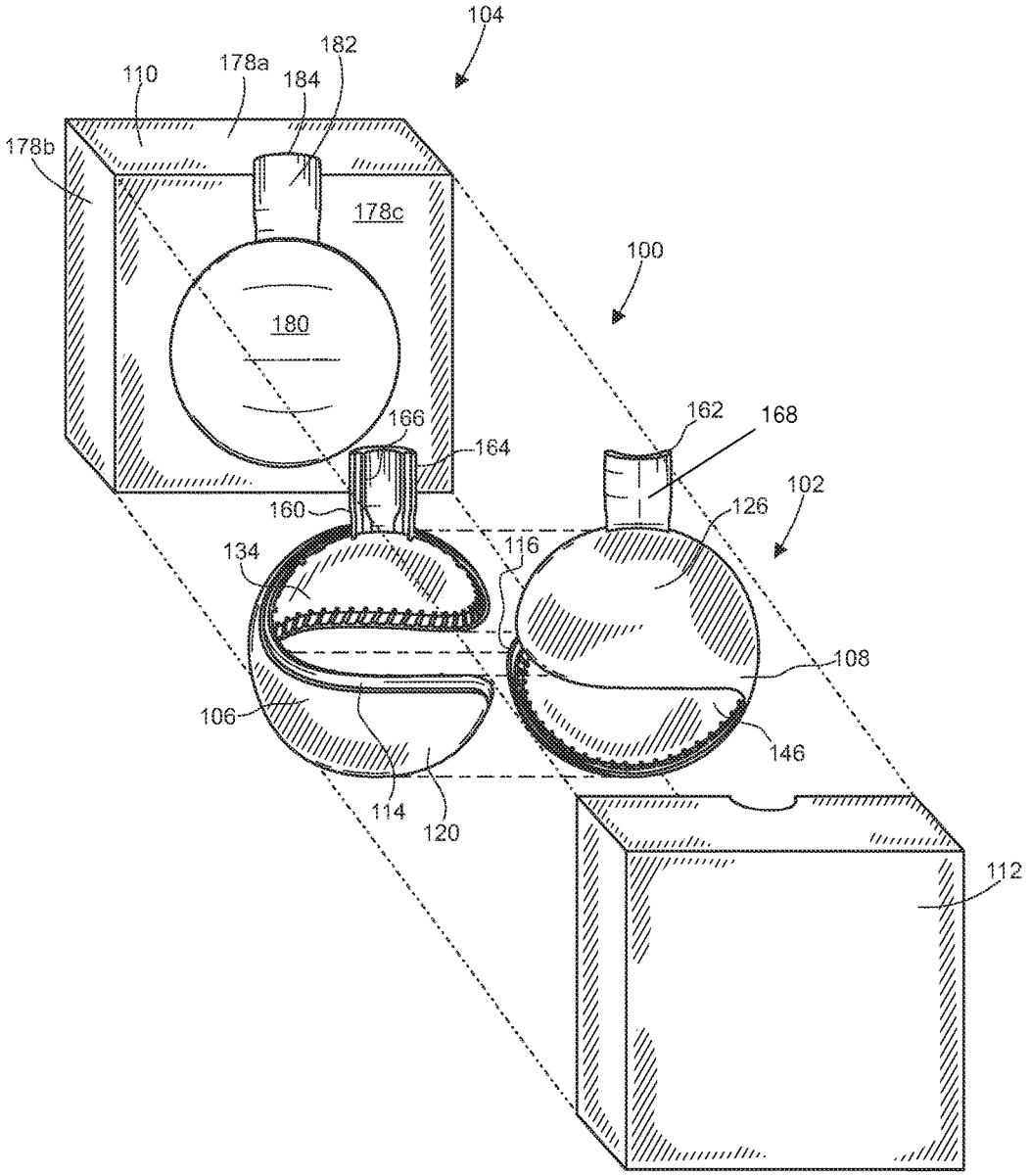
FIG. 5 is an exploded view of a mold for producing the game ball of FIG. 1.

A process for making ball 10 is described below with reference to FIGS. 5-8. Ball 10 is produced in the mold 100 that is shown in FIG. 5. Mold 100 includes an inner mold 102 and an outer, constraining mold 104. Inner mold 102 has mating first and second halves 106 and 108, and constraining mold 104 has mating first and second halves 110 and 112. Each of halves 106 and 108 of first mold 102 is generally C-shaped and corresponds with the C-shape of the sections 16 and 18 of ball 10 shown in FIGS. 1 and 2. The halves 106 and 108 have mating peripheral edges 114 and 116, respectively, that mate where the groove 22 of outer cover 12 is formed. Because the first and second halves 106 and 108 mate where groove 22 is formed, no discernible mold line is formed on the outer cover 12 of ball 10 during the molding process. Instead, the mold line appears to be the seam of a conventional ball. The peripheral edge 116 of second half 108 overlaps the peripheral edge 114 of first half 106 when the halves 106 and 108 mate.

Figure 6:
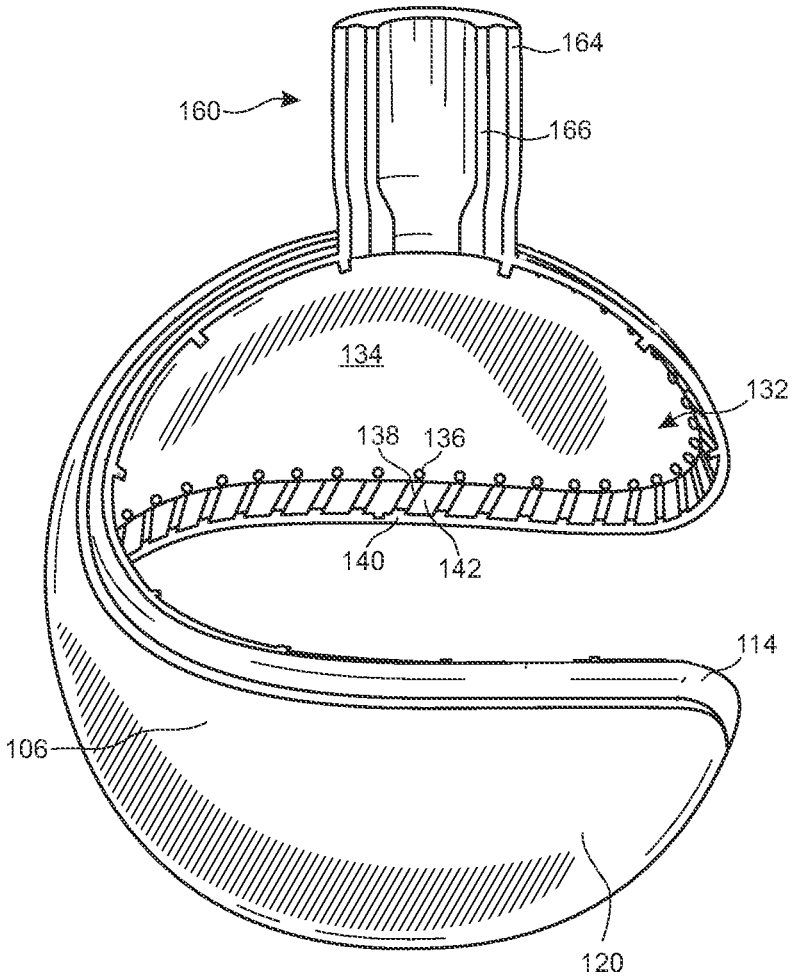
FIG. 6 is a perspective view of one half of an inner portion of the mold shown in FIG. 5.

Referring to FIG. 6, first half 106 has an outer surface 120 and an inner surface 132 with a relatively smooth section 134 for forming the generally smooth C-shaped section 16 of ball 10. The inner surface 132 also has a plurality of hemispherical protrusions, one of which is shown as 136, for forming depressions 24 in the outer cover 12 of ball 10, a plurality of grooves, one of which is shown as 138, for forming protrusions 28 in outer cover 12, and a rounded protrusion 140 for forming one half of groove 22 in outer cover 12. The inner surface 132 also includes a plurality of surfaces 142 positioned between adjacent grooves 138 from rounded protrusion 140 to protrusions 136 for forming the surfaces 36 on ball 10. While surface 142 is shown as being flat, it is within the scope of the invention for the surface 142 to be curved or undulated so that surface 36 on ball 10 more closely resembles a conventional baseball or softball as described above.

The hemispherical protrusions 136, grooves 138, rounded protrusion 140, and surfaces 142 on first half 106 form one half of a pattern that is sized and configured to mimic the inverse of the pattern of the stitching and seam of a conventional, stitched competition softball or baseball. Second half 108 (FIG. 5) also has an outer surface 126 and an inner surface 146 that is configured in a similar manner as the inner surface 132 of first half 106 for forming the outer surface 12 of ball 10. Like the inner surface 132 of first half 106, the inner surface 146 of second half 108 has protrusions and grooves that form one half of a pattern that mimics the inverse of the pattern of the stitching and seam of a conventional, stitched competition softball or baseball such that the first and second halves 106 and 108 when mated form a complete pattern that mimics the inverse of the stitching and seam on a conventional stitched softball or baseball. The pattern on the inner surfaces 132 and 146 of first and second halves 106 and 108 forms the stitch pattern 20 on the outer cover 12 of ball 10.

Referring to FIG. 5, first half 106 has an inlet/outlet structure 160 that extends outward from peripheral edge 114, and second half 108 has an inlet/outlet structure 162 that extends outward from peripheral edge 116. Inlet/outlet structure 160 includes an outer wall 164 and an inner wall 166. Inlet/outlet structure 162 also includes an outer wall 168 and an inner wall (not shown). When inlet/outlet structures 160 and 162 mate, the inner and outer walls of the structures 160 and 162 form an inlet 172 and a pair of outlets 174 and 176, shown in FIG. 7. Inlet 172 receives the material that forms outer cover 12 and inner core 14 of ball 10, while outlets 174 and 176 allow air to vent and exit from the mold 100 during the molding process.

Referring to FIG. 5, the first and second halves 110 and 112 of the constraining mold 104 are substantially identical. Thus, only first half 110 is described in detail herein. The first half 110 is a rectangular prism having a top side 178*a*, bottom side (not shown), left side 178*b*, right side (not shown), front side 178*c*, and back side (not shown). A hemispherical depression 180 is formed in front side 178*c* for receiving inner mold 102. There is also a recess 182 that is formed in the front side 178*c* and that extends from hemispherical depression 180 to top side 178*a* to form an opening 184 in top side 178*a*. When first and second halves 110 and 112 mate, depression 180 and recess 182 in first half 110 and a corresponding depression and recess (not shown) in second half 112 receive inner mold 102.

Figure 7:
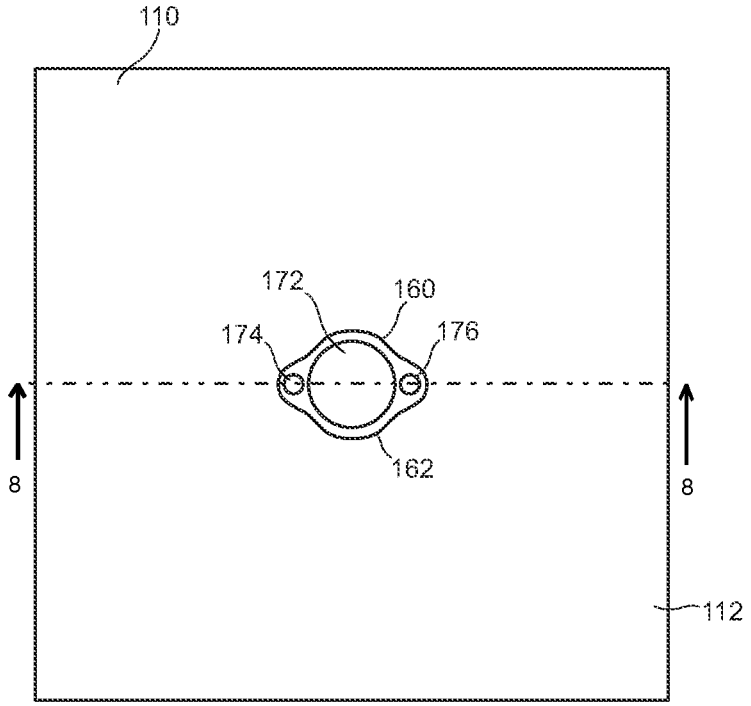
FIG. 7 is a top plan view of the mold as assembled.
Figure 8:
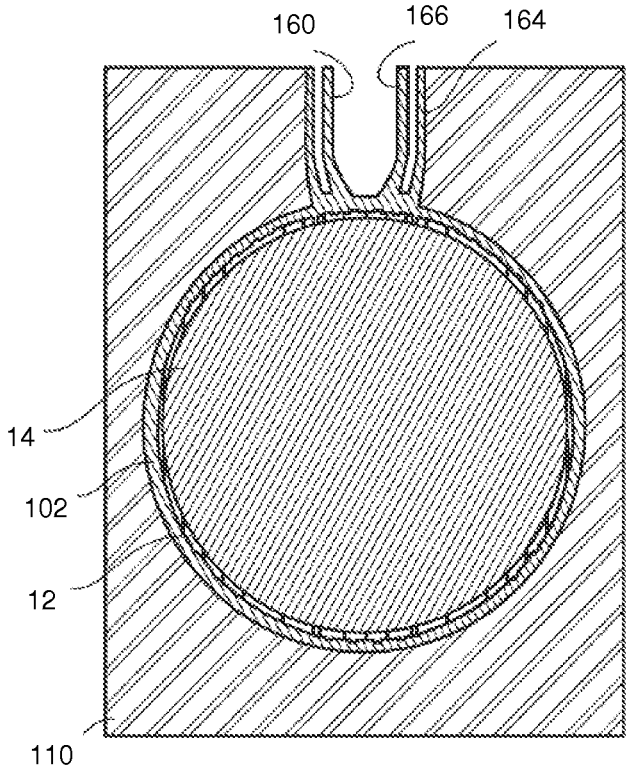
FIG. 8 is a cross-sectional view taken through the line 8-8 in FIG. 7.

A process for making ball 10 in mold 100 begins with forming outer cover 12 by rotational molding. The first and second halves 106 and 108 of inner mold 102 are mated together and positioned within the hemispherical depression 180 and recess 182 in constraining mold 104. The first and second halves 110 and 112 of the constraining mold are then mated together as shown in FIG. 7 and preferably clamped together. A liquid material is inserted into the inner mold 102 through inlet 172. The mold 100 is rotated so that the liquid material generally evenly coats the inner surfaces 132 and 146 of the inner mold 102. Air from the molding process escapes through outlets 174 and 176 (FIG. 7). The liquid material hardens as the mold 100 rotates to form a relatively thin and uniform outer cover 12 of ball 10. Preferably, the liquid material inserted into the mold 100 is liquid polyurethane. After the rotational molding process, outer cover 12 is a flexible hollow sphere or bladder that encloses an interior volume. The stitch pattern 20, shown in FIG. 1, on outer cover 12 is formed by the pattern described above on the inner surfaces 132 and 146 of inner mold 102. Although outer cover 12 is described herein as being formed by rotational molding, it is also within the scope of the invention to form outer cover 12 by blow molding.

After outer cover 12 is formed and solidifies within mold 100, a core material is injected through inlet 172 (FIG. 7) into the interior volume enclosed by outer cover 12 to form the inner core 14 of ball 10. The core material forms inner core 14 and permanently, chemically bonds with the outer cover 12. Inlet 172 is positioned so that the core material is injected through the groove 22 of stitch pattern 20 formed in outer cover 12, which ensures that no discernible injection point is formed on the outer cover 12 during the molding process.

Preferably, the core material is injected into the outer cover 12 during a reaction injection molding process. The core material preferably comprises isocyanate and resin that are injected into the outer cover 12 and that chemically react to form a polyurethane inner core 14 that permanently, chemically bonds to outer cover 12, which is also polyurethane. The isocyanate and resin injected into the outer cover 12 preferably comprise approximately one third of the volume within the outer cover 12. The isocyanate and resin then react and expand to fill the entire volume within the outer cover 12. Preferably, after the isocyanate and resin are injected into the outer cover 12, the mold 100 is flipped or rotated and fed through a heat tunnel for approximately two minutes while the inner core 14 cures. While the inner core 14 cures, air escapes through outlets 174 and 176 (FIG. 7) of mold 100. Mold 100 is flipped or rotated while the inner core 14 cures so that air bubbles within the inner core 14 either escape through the outlets 174 and 176 or are approximately evenly distributed throughout the inner core 14 to ensure that the inner core 14 has a generally consistent density. Air escaping mold 100 through outlets 174 and 176 may cause the portion of outer cover 12 adjacent outlets 174 and 176 to be softer than the remainder of the outer cover 12. Because the outlets 174 and 176 are positioned adjacent to the stitch pattern 20 of outer cover 12, the soft spot of outer cover 12 formed by the escaping air is within the stitch pattern 20. Having a soft spot within stitch pattern 20 does not generally affect the performance or desirability of the ball 10 because the compression of conventional softballs and baseballs is not tested along the stitch pattern 20.

After the inner core 14 hardens and permanently chemically bonds with outer cover 12, the first and second halves 110 and 112 of constraining mold 104 are separated and the first and second halves 106 and 108 of inner mold 102 are separated to remove ball 10. Because the first and second halves 106 and 108 mate along the groove 22 of outer cover 12, no discernible mold line is formed in the outer cover 12 after the ball 10 is removed from the inner mold 102. After the ball 10 is removed from mold 100, paint or ink is preferably applied to the rectangular protrusions 28 and 30 so that they take on the appearance of the stitching of a conventional, stitched competition baseball or softball. The game ball 10 is then ready for use in the same manner as a conventional stitched baseball or softball.

From the foregoing it will be seen that this invention is one well adapted to attain all ends and objectives hereinabove set forth, together with the other advantages which are obvious and which are inherent to the invention.

Since many possible embodiments may be made of the invention without departing from the scope thereof, it is to be understood that all matters herein set forth or shown in the accompanying drawings are to be interpreted as illustrative, and not in a limiting sense.

While specific embodiments have been shown and discussed, various modifications may of course be made, and the invention is not limited to the specific forms or arrangement of parts and steps described herein, except insofar as such limitations are included in the following claims. Further, it will be understood that certain features and subcombinations are of utility and may be employed without reference to other features and subcombinations. This is contemplated by and is within the scope of the claims.

What is claimed and desired to be secured by Letters Patent is as follows:

1. A game ball, comprising:

a molded outer cover having an integral round outer surface, wherein the only mold, line formed in the outer surface includes a groove that mimics the pattern of a seam of a conventional baseball or softball, and wherein said mold line is fainted on the game ball during molding at a joint between at least two sections of a mold that is used to create the game ball, wherein groove of the mold line extends only partially through the molded outer cover such that the molded outer cover is a single unitary component.

2. The game ball of claim 1, wherein said molded outer cover additionally comprises a raised stitch pattern positioned along said mold line on the outer surface of said outer cover.

3. The game ball of claim 1, wherein said mold line comprises a groove positioned between two C-shaped cover sections that are integrally formed together to define said molded outer cover, wherein said C-shaped cover sections have the same size, shape and appearance as the figure eight shaped cover panels of a conventional softball or baseball.

4. The game ball of claim 3, wherein said outer cover additionally comprises a plurality of stitched shaped protrusions extending at an angle from fixed points along said groove to a plurality of corresponding depressions formed in said C-shaped sections.

5. The game ball of claim 4, wherein each of said plurality of corresponding depressions is provided in one of said C-shaped sections spaced equidistant from another one of said corresponding depressions and from said groove.

6. The game ball of claim 4, wherein said molded outer cover additionally comprises a plurality of raised surfaces positioned between adjacent protrusions and extending from said groove to said corresponding depressions.

7. The game ball of claim 1, wherein said outer cover comprises polyurethane.

8. The game ball of claim 7, wherein said outer cover comprises high density polyurethane.

9. The game ball of claim 1, wherein said game ball additionally comprises an inner core that it is enclosed by said outer cover.

10. The game ball of claim 9, wherein said inner core comprises polyurethane.

11. The game ball of claim 9, wherein said inner core is permanently bonded with the outer cover.

12. The game ball of claim 11, wherein said outer cover comprises polyurethane.

13. The game ball of claim 12, wherein said outer cover comprises high density polyurethane.

14. The game ball of claim 13, wherein said inner core comprises low density rigid polyurethane foam.

15. The game ball of claim 14, wherein said ball has approximately the same diameter, density and weight as a conventional competition baseball or softball.

16. The game ball of claim 4, wherein said depressions are pin-hole shaped depressions that mimic the appearance of the hole formed in the cover panels of a conventional softball or baseball through which stitching is threaded to join the panels.

17. The game ball of claim 4, wherein said protrusions generally extend from said groove at about a 45 degree angle.

18. The game ball of claim 6, wherein said plurality of raised surfaces mimic the appearance of the peripheral edge or seam area of the cover panels of a conventional baseball or softball which are raised relative to the remainder of the outer surface of the cover panels when the cover panels are stitched together.

19. The game ball of claim 18, wherein said raised surfaces are generally flat.

20. The game ball of claim 18, wherein said raised surfaces are curved or undulated.

21. The game ball of claim 1, wherein said outer cover has a thickness of between approximately 1.4 to 1.6 millimeters.

22. The game ball of claim 1, wherein said outer cover has a thickness of approximately 1.5 millimeters.

23. A game ball formed by at least two sections of a mold, said game ball, comprising:

a molded outer cover having an integral round outer surface, wherein the only mold line formed in the outer surface along a joint between the at least two sections of the mold includes a groove that mimics the pattern of a seam of a conventional baseball or softball; and an inner core enclosed by said outer cover; wherein the groove of the mold line extends only partially through the molded outer cover such that the molded outer cover is a single unitary component.

24. The game ball of claim 23, wherein said mold line comprises a groove positioned between two C-shaped cover sections that are integrally formed together to define said molded outer cover, wherein said C-shaped cover sections have the same size, shape and appearance as the figure eight shaped cover panels of a conventional softball or baseball.

25. The game ball of claim 24, wherein said stitch pattern comprises a plurality of stitched shaped protrusions extending at an angle from fixed points along said groove to a plurality of corresponding depressions formed in said C-shaped sections.

26. The game ball of claim 25, wherein said molded outer cover additionally comprises a plurality of raised surfaces positioned between adjacent protrusions and extending from said groove to said corresponding depressions.

27. The game ball of claim 23, wherein said inner core is permanently bonded with the outer cover.

28. The game ball of claim 27, wherein said inner core comprises low density rigid polyurethane foam.

29. The game ball of claim 28, wherein said ball has approximately the same diameter, density and weight as a conventional competition baseball or softball.

30. A molded game ball comprising an integral round outer surface, wherein there are no other mold lines formed on the ball other than a mold line formed in the outer surface including a groove that mimics the pattern of a seam of a conventional baseball or softball, and wherein said mold line is formed on the game ball during molding at a joint between at least two sections of a mold that is used to create the game ball, wherein the groove of the mold line extends only partially through the integral outer surface such that the integral outer surface is a single unitary component.

31. The game ball of claim 30, wherein said outer surface additionally comprises a raised stitch pattern positioned along said mold line.

32. The game ball of claim 31, wherein said mold line comprises a groove positioned between two C-shaped cover sections that are integrally formed together to define said outer surface, wherein said C-shaped cover sections have the same size, shape and appearance as the figure eight shaped cover panels of a conventional softball or baseball.

33. The game ball of claim 32, wherein said stitch pattern comprises a plurality of stitched shaped protrusions extending at an angle from fixed points along said groove to a plurality of corresponding depressions formed in said C-shaped sections.

34. The game ball of claim 33, wherein each of said plurality of corresponding depressions is provided in one of said C-shaped sections spaced equidistant from another one of said corresponding depressions and from said groove.

35. The game ball of claim 33, wherein said molded outer cover additionally comprises a plurality of raised surfaces positioned between adjacent protrusions and extending from said groove to said corresponding depressions.

36. The game ball of claim 32, wherein said game ball additionally comprises an inner core that it is enclosed by said outer cover.

37. The game ball of claim 36, wherein said inner core comprises polyurethane.

38. The game ball of claim 36, wherein said inner core is permanently bonded with the outer cover.

39. The game ball of claim 38, wherein said outer cover comprises polyurethane.

40. The game ball of claim 38, wherein said outer cover comprises high density polyurethane.

41. The game ball of claim 40, wherein said inner core comprises low density rigid polyurethane foam.

42. The game ball of claim 41, wherein said ball has approximately the same diameter, density and weight as a conventional competition baseball or softball.

43. The game ball of claim 33, wherein said depressions are pin-hole shaped depressions that mimic the appearance of the hole formed in the cover panels of a conventional softball or baseball through which stitching is threaded to join the panels.

44. The game ball of claim 43, wherein said protrusions generally extend from said groove at about a 45 degree angle.

* * * * *